US010774511B2

(12) United States Patent
Kashirajima et al.

(10) Patent No.: US 10,774,511 B2
(45) Date of Patent: Sep. 15, 2020

(54) FLUSH TOILET

(71) Applicant: TOTO LTD., Kitakyushu-shi, Fukuoka (JP)

(72) Inventors: Shu Kashirajima, Kitakyushu (JP); Yuuki Shinohara, Kitakyushu (JP)

(73) Assignee: TOTO LTD., Fukuoka (JP)

( * ) Notice: Subject to any disclaimer, the term of this patent is extended or adjusted under 35 U.S.C. 154(b) by 0 days.

(21) Appl. No.: 15/626,524

(22) Filed: Jun. 19, 2017

(65) Prior Publication Data

US 2017/0370081 A1 Dec. 28, 2017

(30) Foreign Application Priority Data

Jun. 27, 2016 (JP) ..... 2016-126605

(51) Int. Cl.
*E03D 1/26* (2006.01)
*E03D 11/02* (2006.01)
(Continued)

(52) U.S. Cl.
CPC ..... *E03D 1/263* (2013.01); *E03D 11/02* (2013.01); *E03D 11/08* (2013.01); *E03D 11/18* (2013.01); *E03D 2201/30* (2013.01)

(58) Field of Classification Search
CPC ..... E03D 1/263; E03D 11/02; E03D 11/06; E03D 11/08; E03D 11/18; E03D 1/087
(Continued)

(56) References Cited

U.S. PATENT DOCUMENTS 1,973,349 A * 9/1934 Kruse ..... E03D 11/06 4/425
1,979,739 A * 11/1934 Groeniger ..... E03D 11/06 4/425
(Continued)

FOREIGN PATENT DOCUMENTS

JP H07-243235 A 9/1995
JP 4529178 B2 8/2010
(Continued)

OTHER PUBLICATIONS

An Office Action issued by State Intellectual Property Office dated Apr. 18, 2018, which corresponds to Taiwanese Patent Application No. 106119298 and is related to U.S. Appl. No. 15/626,524; with brief English translation on the first page.
(Continued)

*Primary Examiner* — Tuan N Nguyen
(74) *Attorney, Agent, or Firm* — Studebaker & Brackett PC

(57) ABSTRACT

A flush toilet is provided, which can enhance discharge performance of waste from an inside of a water discharge trap conduit even with a smaller amount of flushing water, in the flush toilet discharging waste by a siphon action. A flush toilet of the present invention has a bowl section, a water discharge trap conduit, and a jet spout port connected to a lower portion of the bowl section and opened toward the water discharge trap conduit, with an outlet portion bottom surface of an outlet portion thereof and a bottom surface of the bowl section being connected, and a bottom surface of the bowl section forms a curved surface that diagonally inclines more downward than the outlet portion bottom surface from a tip end of an outlet portion bottom surface of the jet spout port.

4 Claims, 7 Drawing Sheets

(51) Int. Cl.
*E03D 11/18* (2006.01)
*E03D 11/08* (2006.01)

(58) Field of Classification Search
USPC ..... 4/425
See application file for complete search history.

(56) References Cited

U.S. PATENT DOCUMENTS

| | | | | |
|---|---|---|---|---|
| 2,129,398 | A * | 9/1938 | Beam | E03D 11/06 4/425 |
| 2006/0005310 | A1 | 1/2006 | Nakamura et al. | |
| 2012/0198610 | A1 | 8/2012 | McHale et al. | |

FOREIGN PATENT DOCUMENTS

| | | | |
|---|---|---|---|
| JP | 5429688 | B2 | 2/2014 |
| TW | I247838 | B | 1/2006 |

OTHER PUBLICATIONS

An Office Action; "Notification of Reasons for Refusal," mailed by the Japanese Patent Office dated Mar. 12, 2020, which corresponds to Japanese Patent Application No. 2016-126605 and is related to U.S. Appl. No. 15/626,524; with English language translation.

* cited by examiner

FLUSH TOILET

TECHNICAL FIELD

The present invention relates to a flush toilet, and particularly relates to a flush toilet that is washed by flushing water supplied from a flushing water source to discharge waste.

BACKGROUND ART

Conventionally, there have been known siphon jet type flush toilets as described in Patent Document 1 (Japanese Patent No. 5429688) and Patent Document 2 (Japanese Patent No. 4529178). In these conventional siphon jet type flush toilets, as illustrated in FIG. 6, there has been known the one in which a jet spout port 132 extending rectilinearly toward a center of an inlet portion 122*a* of a water discharge trap conduit 122 is disposed in order to perform startup of a siphon and discharge of waste efficiently by a jet spout water flow, in a flush toilet 101. A bowl section bottom surface 120*a* of a bowl section 120 which is connected to an outlet of the jet spout port 132 like this extends rectilinearly toward the center of the inlet portion 122*a* of the water discharge trap conduit 122 from the outlet of the jet spout port 132.

SUMMARY OF THE INVENTION

Technical Problem

However, when the water force of jet spout water flow heading toward the center of the inlet portion 122*a* of the water discharge trap conduit 122 from the jet spout port 132 is increased in order to start up a stronger siphon, the jet spout water flow easily diffuses as a result of flowing out to a relatively wide region in the bowl section 120 in the vicinity of the bowl section bottom surface 120*a* from the inside of the jet spout port 132, and the water force drops at once (the water force to break water flow is gone). Therefore, the flow that goes rectilinearly along the bowl section bottom surface 120*a* is formed. Consequently, the above described structure has had the problem of causing the jet spout water flow to collide with the trap rising pipe of the water discharge trap conduit 122 to cause a loss in flow of flushing water, and being unable to push waste into the water discharge trap conduit 122 to reduce discharge performance of waste. In addition, there has been the problem that the jet discharge water flow collides with the trap rising pipe of the water discharge trap conduit 122 to inhibit the flow, so that timing for startup of a siphon action cannot be advanced.

Further, as illustrated by an analysis result in FIG. 6, in the conventional flush toilet including the jet spout port 132 that rectilinearly extends toward the center of the inlet portion 122*a* of the water discharge trap conduit 122, the jet spout water flow collides with a region E on a bottom surface of the opposing water discharge trap conduit 122 in front to cause a loss to the flow of flushing water.

Consequently, the present invention is made to solve the problems of the conventional arts described above, and has an object to provide a siphon type flush toilet that can enhance discharge performance of waste from an inside of a water discharge trap conduit even with a smaller amount of flushing water.

Solution to Problem

In order to attain the aforementioned object, the present invention is a flush toilet that is washed by flushing water supplied from a flushing water source, including a bowl section including a bowl-shaped waste receiving surface, and a rim section formed on an upper edge of the waste receiving surface, a water discharge trap conduit that is connected to a lower portion of the bowl section, and a jet spout port that is connected to the lower portion of the bowl section and is opened toward the water discharge trap conduit, wherein an outlet portion bottom surface of an outlet portion thereof and a bottom surface of the bowl portion are connected, wherein the bottom surface of the bowl section includes a curved surface that diagonally inclines more downward than the outlet portion bottom surface from a tip end of the outlet portion bottom surface of the jet spout port.

In the present invention configured in this way, a part of the jet spout water flow spouted along the outlet portion bottom surface of the outlet portion of the jet spout port forms flow along the bottom surface of the bowl section forming a curved surface diagonally inclined more downward than the output portion bottom surface from the tip end of the outlet portion bottom surface, by a Coanda effect. Accordingly, the jet spout water flow that advances the timing for startup of the siphon action by reaching the water discharge trap conduit relatively early along the bottom surface of the bowl section, and the jet spout water flow that forms the flow that pushes waste toward the water discharge trap conduit from the jet spout port can be formed. Thereby, according to the present invention, in the siphon type flush toilet, discharge performance of waste from the inside of water discharge trap conduit can be enhanced even with a smaller amount of flushing water.

In the present invention, it is preferable that the jet spout port is opened toward lower side than a central portion in an inlet of the water discharge trap conduit.

In the present invention configured in this way, the jet spout port spouts the jet spout water flow toward lower side than the central portion in the inlet of the water discharge trap conduit. Therefore, the jet spout water flow joins the flow along the bottom surface of the bowl section by the Coanda effect, in the state in which the flow along the bottom surface of the bowl section keeps relatively strong water force. Consequently, according to the present invention, both the flows are combined to be able to form the flow that smoothly flows in the water discharge trap conduit, and the jet spout water flow can be restrained from generating the flow that hinders the flow in the water discharge trap conduit by colliding with the inner surface of the water discharge trap conduit.

In the present invention, it is preferable that a ratio of an inclination angle of a rising conduit of the water discharge trap conduit to horizontal, and an inclination angle of the jet spout port to horizontal is set as a ratio in a range of 26:1 to 6.5:1.

In the present invention configured in this way, the jet spout water flow joins the flow along the bottom surface of the bowl section by the Coanda effect, in the state in which the flow along the bottom surface of the bowl section has relatively strong water force. Accordingly, both the flows are combined to be able to form the flow that smoothly flows in the water discharge trap conduit, and the jet spout water flow can be restrained from generating the flow that hinders the flow in the water discharge trap conduit by colliding with the inner surface of the water discharge trap conduit.

In the present invention, it is preferable that an angle between the outlet portion bottom surface of the jet spout port and a tangential line of the bottom surface of the bowl section, which extends downward from the tip end of the outlet portion bottom surface, is formed in a range of 140 degrees to 165 degrees.

In the present invention configured in this way, the angle between the outlet portion bottom surface of the jet spout port, and the tangential line of the bottom surface of the bowl section, which extends downward from the tip end of the outlet portion bottom surface is formed to be the angle in the range of 140 degrees to 165 degrees, so that a part of the jet spout water flow is drawn to the bowl section bottom surface and can flow along the bowl section bottom surface by the Coanda effect. Therefore, according to the present invention, the jet spout water flow that advances the timing for startup of the siphon action by reaching the water discharge trap conduit relatively early along the bottom surface of the bowl section, and the jet spout water flow that forms the flow that pushes waste toward the water discharge trap conduit from the jet water spout section can be formed.

Advantageous Effects of the Invention

According to the flush toilet of the present invention, in the siphon type flush toilet, discharge performance of waste from the inside of the water discharge trap conduit can be enhanced even with a smaller amount of flushing water.

DESCRIPTION OF EMBODIMENTS

Hereunder, a flush toilet according to one embodiment of the present invention will be described with reference to the drawings.

First, based in FIGS. 1 to 3, a basic structure of the flush toilet according to the one embodiment of the present invention will be described.

Figure 1:
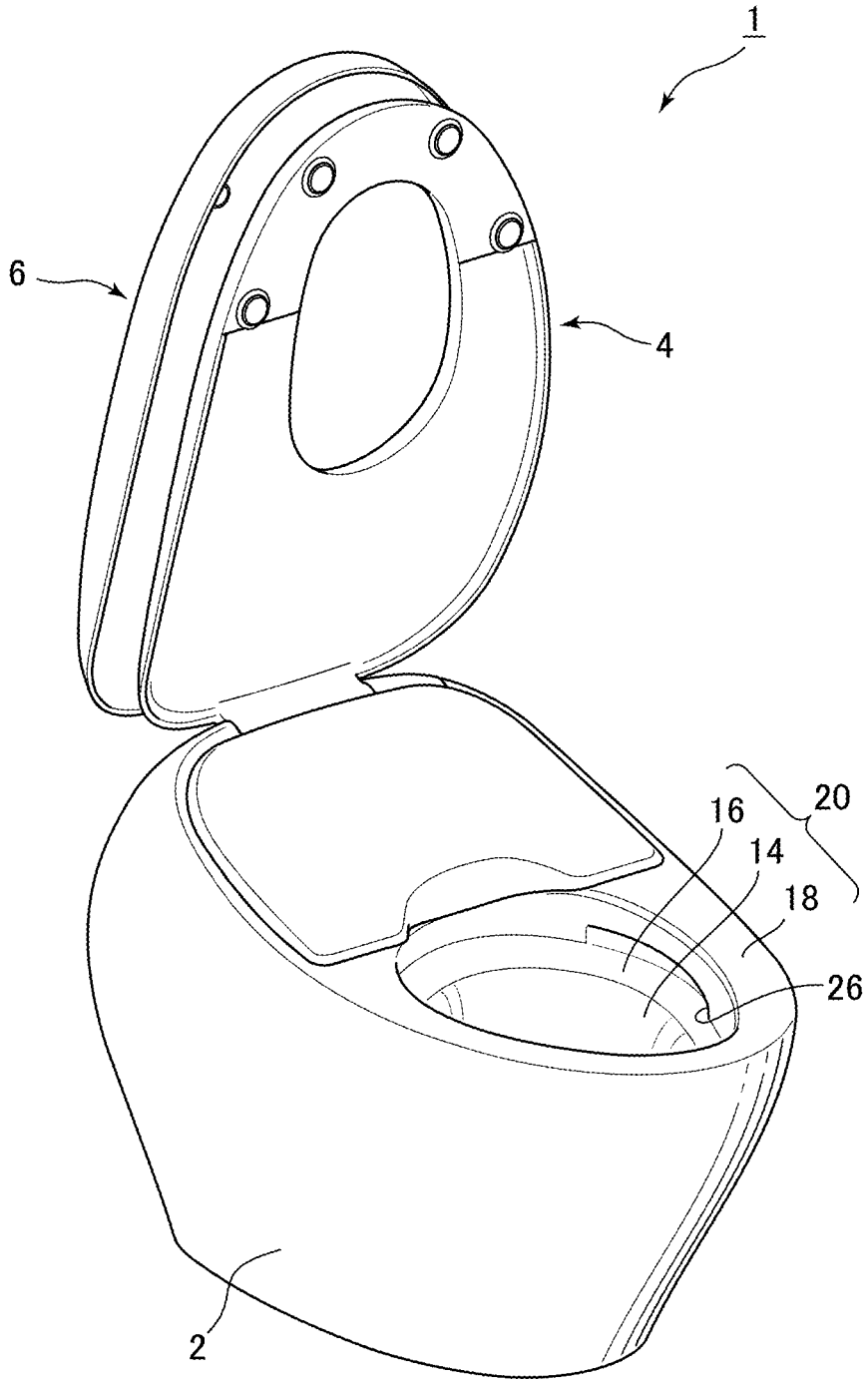
FIG. 1 is a perspective view illustrating a flush toilet according to one embodiment of the present invention, and illustrates a state in which a toilet lid and a toilet seat are turned to an upper position.
Figure 2:
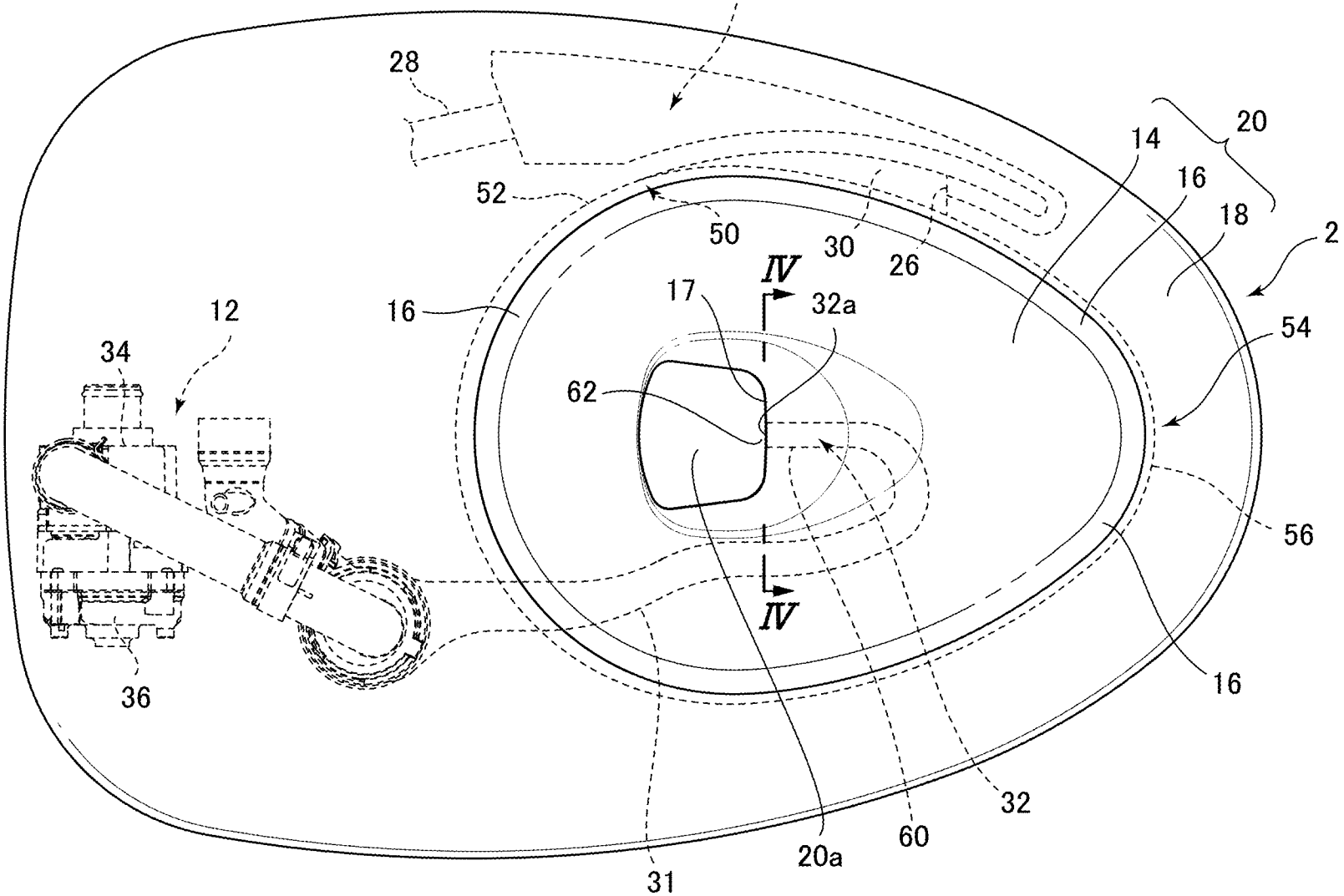
FIG. 2 is a plan view illustrating a toilet main body section of the flush toilet according to the one embodiment of the present invention illustrated in FIG. 1.
Figure 3:
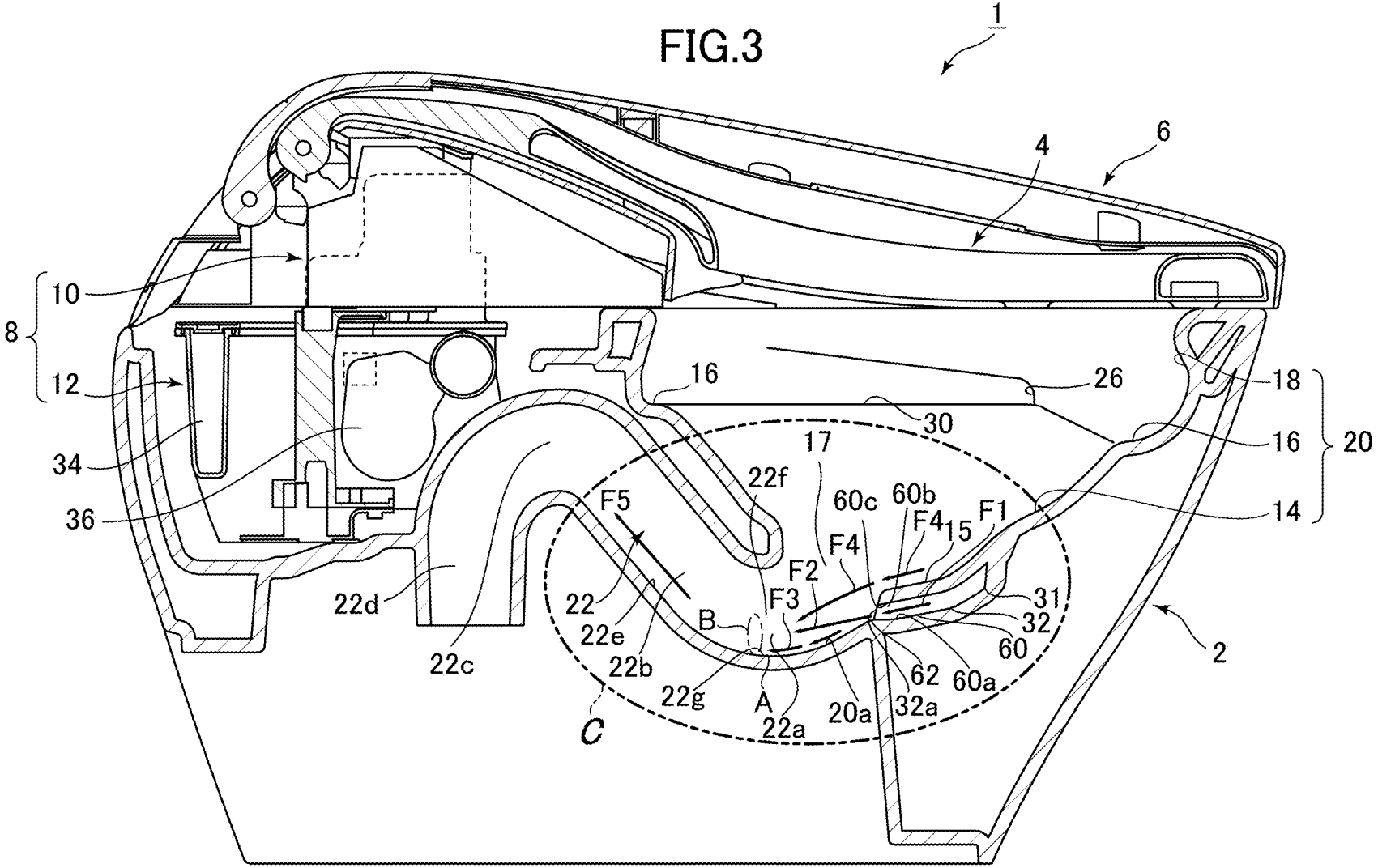
FIG. 3 is a sectional view of a section along a center in a lateral direction in the flush toilet according to the one embodiment of the present invention, seen from a left side, and illustrates a state in which the toilet lid and the toilet seat are turned to a lower position.

As illustrated in FIGS. 1 to 3, a flush toilet 1 according to the one embodiment of the present invention includes a toilet main body 2 made of ceramic, a toilet seat 4 disposed on a top surface of the toilet main body 2 to be capable of turning in a vertical direction, a toilet lid 6 disposed to be capable of turning in the vertical direction to cover the toilet seat 4, and a function section 8 disposed at a rear part of the toilet main body 2.

As illustrated in FIG. 3, the function section 8 includes a sanitary cleaning system function section 10 functioning as a sanitary cleaning section that cleans private parts of a user, and a water supply system function section 12 relating to a function of water supply to the toilet main body 2.

Next, as illustrated in FIG. 1, the toilet main body 2 includes a bowl section 20, and the bowl section 20 includes a bowl-shaped waste receiving surface 14, and a rim section 18 formed to be raised from a ledge surface 16 on an upper edge of the waste receiving surface 14.

Here, as illustrated in FIG. 3, the toilet main body 2 includes a water discharge trap conduit 22 connected to a lower part of the bowl section 20, and the water discharge trap conduit 22 forms a drain path for discharging waste in the bowl section 20.

Next, as illustrated in FIG. 2, in the bowl section 20, a rim water path 24 is formed inside the rim section 18 in a right side of a front part of the toilet main body 2. Further, an upstream side of the rim water path 24 is connected to a water conduit 28 that conducts flushing water, and an upstream side of the water conduit 28 is directly connected to city water utility (not illustrated) that is a flushing water source. By using pressure of water supply of city water utility, flushing water that is supplied into the rim water path 24 from the water conduit 28 is led forward in the rim water path 24, and thereafter, bends inward and to a rear side to be led to a rim spout port 26 formed in a downstream end of the rim water path 24.

The rim spout port 26 in the rim water path 24 may be disposed in a position in a left side of the front part, a position in a right side of a rear part, or a position in a left side of the rear part, of the toilet main body 2.

Further, as illustrated in FIG. 2, a jet spout port 32 (a jet spout port) is formed at a lower portion of the bowl section 20, and the jet spout port 32 is opened to be directed to an inlet portion 22*a* of the water discharge trap conduit 22. The jet spout port 32 forms a flow path extending rectilinearly to the rear part from the front part of the toilet main body 2, in plan view.

Here, the aforementioned water supply system function section 12 includes a water storage tank 34, and flushing water stored in the water storage tank 34 is pressurized by a pressure pump 36 to be supplied to the jet spout port 32. Therefore, the jet spout port 32 is formed in a downstream end portion of the jet water conduit 31 extending from the water storage tank 34.

When a water supply using water utility direct pressure supply is adopted as a supply water source for supplying flushing water to the jet water conduit 31, the pressure pump 36 may be omitted, because water that is pressurized by supply water pressure of city water utility is supplied.

As illustrated in FIG. 2, the jet water conduit 31 extends while descending forward from the rear part at the left side of the toilet main body 2 in top view, and forms a flow path that is along an outer side of a back surface of the waste receiving surface 14. The jet water conduit 31 extends toward a front side at a side part of a water storage portion, and thereafter extends toward a center of the toilet main body 2. Further, the jet water conduit 31 turns a direction rearward in a front side of the water storage portion to extend toward the water storage portion 17. In the jet water conduit 31, a flow path shape like this is made of ceramic.

Here, detailed explanation of respective specific structures of the sanitary cleaning system function section 10 and the water supply system function section 12 will be omitted since the specific structures thereof are similar to the conventional ones. The water supply system function section 12 is provided with a controller or the like that controls an on/off operation of an electromagnetic valve, a switching operation of a changeover valve, and a number of revolutions, an operating time period and the like of the pressure pump.

The flush toilet 1 according to the present embodiment is a so-called hybrid type flush toilet, and performs rim water spout by the rim spout port 26 by using water supply pressure of city water, and performs jet water spout by the jet spout port 32 by supplying flushing water in the water storage tank 34 by controlling the pressure pump 36. The flush toilet may switch the flushing water from city water to rim water spout by the rim spout port 26 and jet water spout by the jet spout port 32 by switching a valve. Further, the flush toilet may switch the flushing water which is supplied from the water storage tank to rim water spout by the rim spout port 26 and jet water spout by the jet spout port 32.

Next, with reference to FIGS. 2 to 4, detailed structures of the jet spout port 32 of the jet water conduit 31, and the bowl section bottom surface 20*a* of the bowl section 20 to which the jet spout port 32 is connected will be described.

A flat surface 15 is formed in front of the water storage portion 17 of the waste receiving surface 14. The jet spout port 32 is formed at a lower side of the flat surface 15. The flat surface 15 is a surface that lowers toward the water storage portion 17 in a rear side from a front side of the waste receiving surface 14. As shown by an arrow F6 in FIG. 3*b*, flushing water flowing on the flat surface 15 flows down along an inclined surface to be a relatively rectified flow heading toward the inlet of the water discharge trap conduit 22, in the storage portion 17. Accordingly, the flat surface 15 can enhance an ability to push waste into the water discharge trap conduit 22 and discharge the waste.

The jet spout port 32 includes a flow path portion 60, and the flow path portion 60 extends to an outlet 32*a*. The outlet 32*a* of the flow path portion 60 opens to the inlet portion 22*a* of the aforementioned water discharge trap conduit 22. The flow path portion 60 includes a lower end portion bottom surface 60*a* (an outlet portion bottom surface) extending diagonally downward to the outlet 32*a* at a lower end portion of the jet spout port 32, side walls 60*b* raised upward from both sides of the lower end portion bottom surface 60*a*, and a ceiling surface 60*c* extending toward the outlet 32*a*, and extending substantially parallel with the lower end portion bottom surface 60*a*. The jet spout port 32 may have a lower portion than the outlet 32*a* in an internal flow path thereof.

Figure 4:
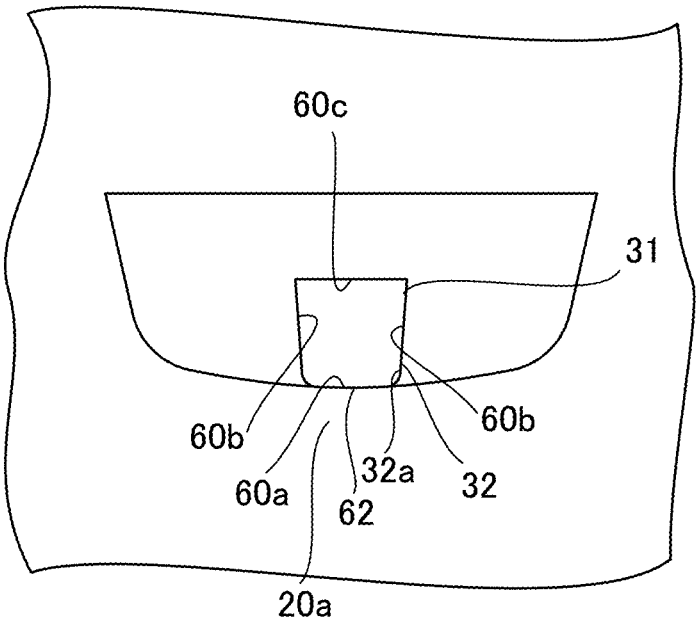
FIG. 4 is a partial enlarged view of a jet spout port in a jet water conduit in the flush toilet according to the one embodiment of the present invention illustrated in FIG. 1, seen from a water discharge trap conduit side.

As illustrated in FIG. 4, the flow path portion 60 of the jet spout port 32 forms a flow path having a substantially quadrangular section along the lateral direction. The lower end portion bottom surface 60*a* and/or the ceiling surface 60*c* of the flow path portion 60 may form a bent shape, for example, a tube-shaped section, for example, along the lateral direction.

The flow path portion 60 of the jet spout port 32 is formed to narrow a sectional area of the flow path of the jet water conduit 31 by the lower end portion bottom surface 60*a*, the side walls 60*b* and the ceiling surface 60*c*. A throttle portion with a substantially same flow path sectional area is formed over a fixed length. The throttle portion may be disposed in any position in the jet water conduit 31. Widths of the left and right side walls may be narrowed, or a height from a floor surface to the ceiling surface may be narrowed. Further, the throttle portion may be formed in a shape of a protruded portion protruded from a wall surface, in a mound shape, an arc shape, a semispherical shape or the like.

The lower end portion bottom surface 60*a* of the flow path portion 60 of the jet spout port 32 forms a substantially flat plane. The lower end portion bottom surface 60*a* of the flow path portion 60 forms a diagonal surface with a downward inclination toward a rear portion side of the bowl section 20.

Figure 3B:
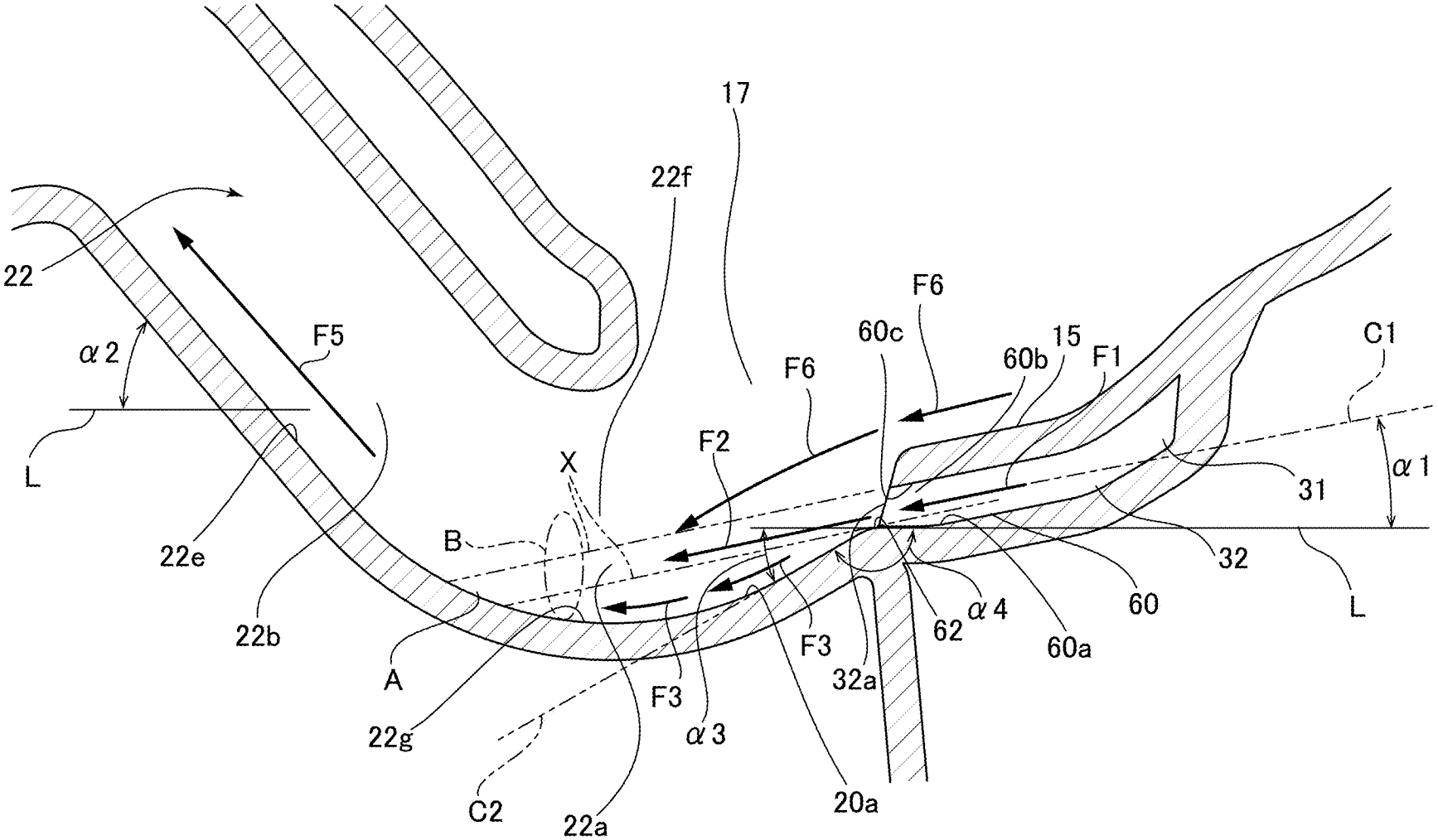
FIG. 3*b* is a partial enlarged sectional view enlarging and illustrating a region C in FIG. 3.

As illustrated in FIG. 3*b*, an angle $\alpha$1 of an inclination of a center line C1 (or the lower end portion bottom surface 60*a* of the flow path portion 60) of the flow path portion 60 of the jet spout port 32 to a horizontal plane L is formed to be an angle in a range of 5 degrees to 20 degrees. In a region in a vicinity of the outlet 32*a*, the center line C1 of the flow path portion 60 and the lower end portion bottom surface 60*a* of the flow path portion 60 are formed to have a substantially same inclination angle. The lower end portion bottom surface 60*a* of the flow path portion 60 may be formed substantially horizontally.

An angle $\alpha$2 of an inclination of a rising conduit 22*b* (or a rising conduit bottom surface 22*e* of the rising conduit 22*b*) of the water discharge trap conduit 22 to the horizontal plane L is formed to be an angle in a range of 120 degrees to 140 degrees. Consequently, a ratio of the angle $\alpha$2 of the inclination of the rising conduit 22*b* to the horizontal plane L, and the angle $\alpha$1 of the inclination of the flow path portion 60 to the horizontal plane L is set at a ratio in a range of 26:1 to 6.5:1.

A position of the lower end portion bottom surface 60*a* being extended to the inlet portion 22*a* of the water discharge trap conduit 22 (that is, a position of the horizontal plane L being extended to the inlet portion 22*a*) is a position in a vicinity of a central portion of the inlet portion 22*a*.

The outlet 32*a* of the flow path portion 60 of the jet spout port 32 is located slightly upward from a lowermost end of the bowl section bottom surface 20*a*. The bottom surface 20*a* of the bowl section 20 in a vicinity of the outlet 32*a* of the flow path portion 60 forms a surface extending diagonally downward from the outlet 32*a* of the jet spout port 32.

A downward inclination of the bottom surface 20*a* of the bowl section 20 is a steeper downward inclination than a downward inclination of the lower end portion bottom surface 60*a* of the jet spout port 32. The downward inclination of the bottom surface 20*a* of the bowl section 20 is a steeper downward inclination than a downward inclination of the flow path portion 60 (an inclination of the center line C1 of the flow path portion 60).

An angle $\alpha$3 of an inclination of a tangential line C2 of the bottom surface 20*a* of the bowl section 20 to the horizontal plane L is formed to be an angle in a range of 15 degrees to 40 degrees. For example, the bowl portion bottom surface 20*a* forms a flow path that opens slightly downward with respect to an extending direction of the jet spout port 32, and thereby generates a Coanda effect that draws a part of jet discharge water flow so as to be along the bottom surface 20*a* of the bowl section 20.

The bottom surface 20*a* of the bowl section 20 is disposed immediately after the outlet 32*a* of the flow path portion 60, and thereby can cause a Coanda effect efficiently.

A corner portion 62 is formed between the lower end portion bottom surface 60*a* of the flow path portion 60 of the jet spout port 32, and the bowl portion bottom surface 20*a*. The corner portion 62 is formed in an arc shape, and a radius of curvature of the corner portion 62 is preferably formed in a range of 10 mm to 30 mm, and more preferably formed to be 15 mm. An angle of the corner portion 62 is formed to be an obtuse angle.

An angle α4 between the lower end portion bottom surface 60*a* of the flow path portion 60 of the jet spout port 32 and the bottom surface 20*a* of the bowl section 20 (the tangential line C2 of the bowl portion bottom surface 20*a*) is formed to be an angle in a range of 140 degrees to 165 degrees.

The angle α4 is set as an angle that makes it difficult for a part of jet spout water flow to remove from the corner portion 62, and enables the part of jet spout water to flow along the bowl portion bottom surface 20*a* in the region in the vicinity of the outlet 32*a* by a Coanda effect.

When the bowl portion bottom surface 20*a* extends downward in a substantially vertical direction from the outlet 32*a*, it is difficult to cause a part of jet spout water flow to flow along the bowl portion bottom surface 20*a* by the Coanda effect, and therefore it is not preferable to adopt the structure like this.

As illustrated in FIG. 4, the side wall 60*b* of the flow path portion 60 of the jet spout port 32 forms a substantially flat plane. Each of the side walls 60*b* is formed so that an upper portion thereof slightly opens more outward than a lower portion along the lateral direction.

The ceiling surface 60*c* of the flow path portion 60 of the jet spout port 32 forms a substantially flat plane. The ceiling surface 60*c* extends rectilinearly toward the outlet 32*a*. Further, the ceiling surface 60*c* has an inclination heading to a lower side from the central portion 22*f* of the inlet portion 22*a* of the water discharge trap conduit 22 and to an upper side from the bottom surface 22*g*.

As illustrated in FIG. 3*b*, the outlet 32*a* of the flow path portion 60 of the jet spout port 32 is opened to a lower side region B in lower side than the central portion 22*f* and in the upper side from the bottom surface 22*g*.

As illustrated in FIG. 3*b*, virtual lines X obtained by virtually extending the flow path in the outlet 32*a* of the flow path portion 60 in a direction of the opening reach the lower side region B between the central portion 22*f* and the bottom surface 22*g*.

Next, with reference to FIGS. 1 to 5, an operation (action) of the flush toilet according to the one embodiment of the present invention will be described.

Figure 5:
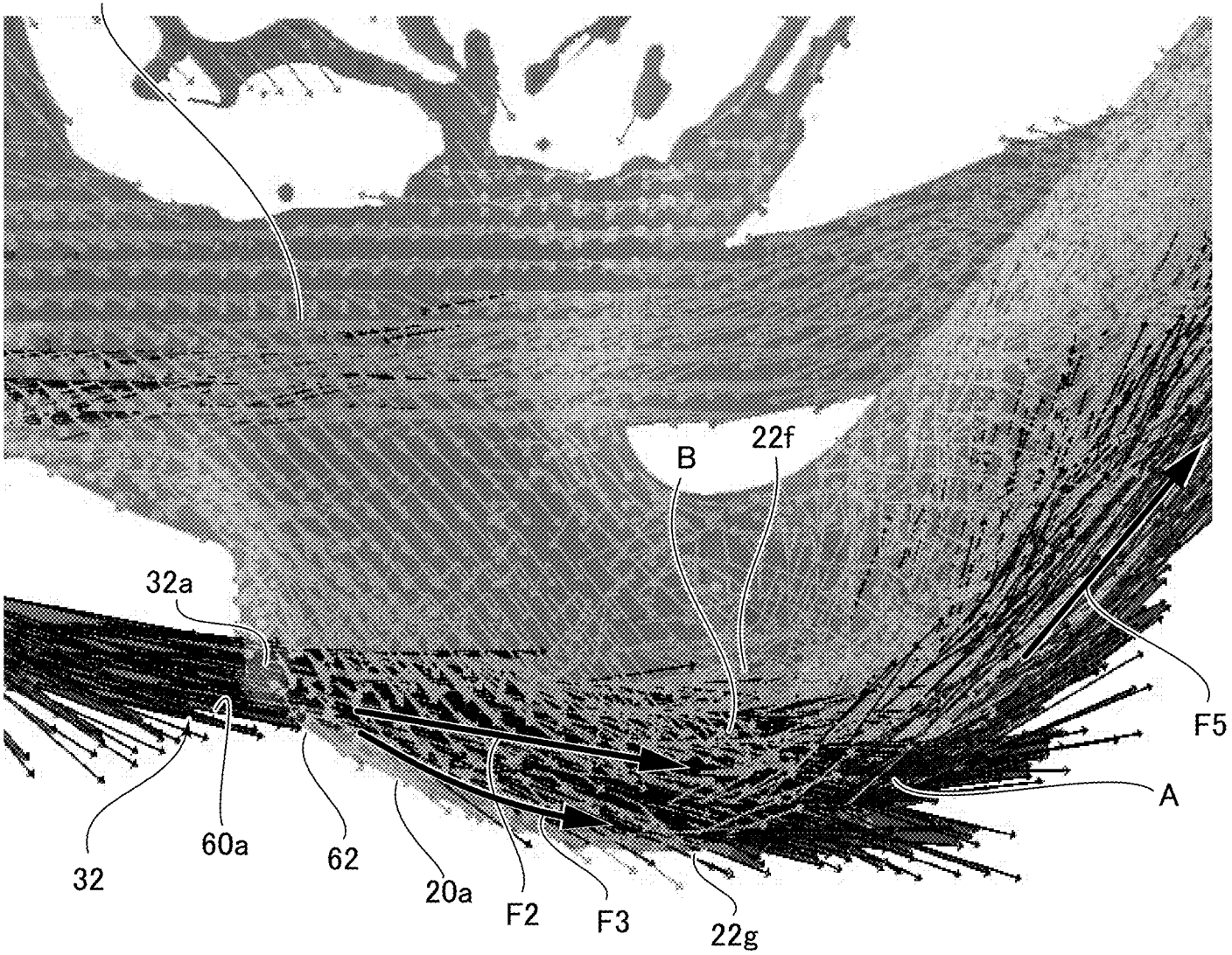
FIG. 5 is an analytical diagram illustrating one example of a result of analyzing distribution of flow velocities in a vicinity of an inlet portion of the water discharge trap conduit, of jet spout water flow spouted from the jet spout port, and flow of a part of the jet spout water flow flowing further along a bowl section bottom surface diagonally inclined downward from an outlet of the jet spout port, at a time of performing toilet flushing by using the flush toilet according to the one embodiment of the present invention.

In a numerical analysis result illustrated in FIG. 5, directions of flows of flushing water are shown by arrows, long arrows in dark colors (dark gray and color close to black) in terms of density indicate regions where the flow velocity of flushing water is high and water force is strong, and short arrows in light colors (light gray and color substantially close to white) in terms of density indicate regions where the flow velocity of flushing water is low and water force is weak.

When a user presses an operation button (not illustrated) for washing stool after usage of the toilet, a signal from the operation button (not illustrated) is transmitted to a controller (not illustrated), and a washing operation for washing stool of the flush toilet 1 is started. When the user operates the operation button (not illustrated), the controller allows flushing water to pass through the water conduit 28, and the rim water path 24 from the water supply source such as city water, and spouts the flushing water rearward from the rim spout port 26. The flushing water spouted from the rim spout port 26 forms a swirl flow that flows downward while swirling in the bowl section 20 through the water passage 30 to wash an inner wall surface of the bowl section 20.

Thereafter, jet water spout is started. First, the controller transmits a signal to the pressure pump 36 to actuate the pressure pump 36. The flushing water stored in the water storage tank 34 flows into the pressure pump 36 and is pressurized. The flushing water pressurized by the pressure pump 36 passes through the jet water conduit 31 to be spouted from the jet spout port 32 which is opened in the lower portion (bottom portion) of the bowl section 20.

The flow velocity of the flushing water flowing down in the jet water conduit 31 is accelerated by the throttle portion of the flow path portion 60 (an outlet portion) in the jet spout port 32, because the flow path sectional area is narrowed more than that at the upstream side of the throttle portion. Since the flow velocity of the flushing water is accelerated in the flow path portion 60, the flow velocity of the flushing water passing in the flow path portion 60 is accelerated to easily generate the Coanda effect that a part of the jet spout water flow spouted from the jet spout port 32 is drawn so as to be along the bowl section bottom surface 20*a*. In addition, the flow velocity of the flushing water spouted from the jet spout port 32 is accelerated, so that the water discharge trap conduit 22 is filled relatively early to be able to advance timing for startup of a siphon action that discharges waste.

As illustrated in FIGS. 3*b* and 5, a main flow of the flushing water flowing in the flow path portion 60 flows along a direction of the center line C1 of the flow path portion 60, and flows out from the outlet 32*a* of the flow path portion 60 in the direction of the center line C1 of the flow path portion 60, as shown by an arrow F1 in FIG. 3*b*. As shown by an arrow F2, the jet spout water flow which flows out from the outlet 32*a* of the flow path portion 60 forms a main flow with a relatively strong water force along the direction of the virtual line X, and passes through the lower side region B to reach a position A on the bottom surface 22*g* of the water discharge trap conduit 22. At this case, the flow heading to the lower side region B discharges waste in such a manner as to push the waste into the inlet portion 22*a* of the water discharge trap conduit 22. The jet spout water flow which heads to the lower side region B pushes waste (stool, toilet paper and the like) which falls toward the vicinity of the bottom surface 22*g* of the bowl section 20 to the water discharge trap conduit 22 relatively strongly. The jet spout water flow like this joins the flow with relatively strong water force which is generated by the Coanda effect and flows at a lower side of the water discharge trap conduit 22, and discharges the waste relatively efficiently with the flow with the relatively strong water force.

Figure 6:
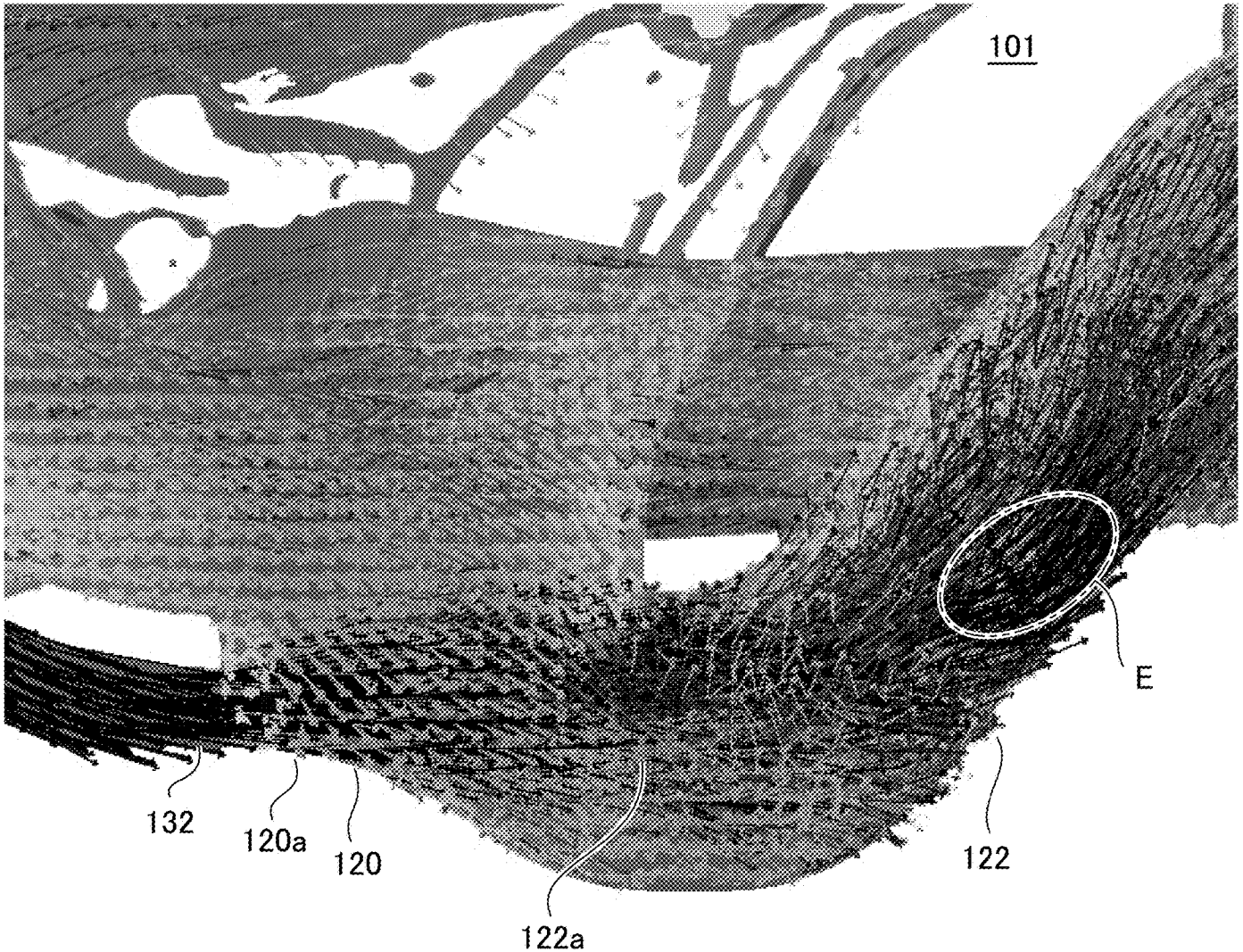
FIG.6 (Prior Art)
FIG. 6 is an analytic diagram illustrating a result of analyzing distribution of a flow velocity in the vicinity of an inlet portion in a water discharge trap conduit, of jet spout water flow spouted along a bottom surface of a bowl section, which extends rectilinearly toward a center of the inlet portion of the water discharge trap conduit from an outlet of a jet spout port, at a time of performing toilet flushing in a conventional flush toilet, as a comparative example of the analysis result illustrated in FIG. 5.

As shown by an arrow F3 in FIG. 5, a part of jet spout water flow spouted from the jet spout port 32 is divided from the main flow of the jet spout water flow, and generates the Coanda effect of being drawn so as to be along the bowl section bottom surface 20*a*. The jet spout water flow flowing out from the outlet 32*a* of the flow path portion 60 flows out to a relatively wide region in the bowl section 20, so that the water force and the flow velocity decrease immediately after flowing out. Thus, the bowl section bottom surface 20*a* is formed in a region in the vicinity of the outlet 32*a* which is a region where the water force of the jet spout water flow is relatively strong and the flow velocity is high. Thereby, the flow with relatively strong water force and a high flow velocity can efficiently generate the Coanda effect. In a region with flow with relatively weak water force and a low flow velocity, a tendency to keep a direction and a flow velocity of an original flow is stronger than a tendency to be drawn to a predetermined surface by the Coanda effect, so that an action of the Coanda effect is weak (refer to FIG. 6 of the conventional art, for example). Here, the inclination angle of the flow path portion 60 to the horizontal plane, and the inclination angle of the bowl section bottom surface 20*a* to the horizontal surface are formed to have a fixed relationship, so that a part of the jet spout water flow flowing out of the jet spout port 32 can flow along the bowl section bottom surface 20*a* by the Coanda effect, also in a region after bend of the corner portion 62. At this case, the bend of the corner portion 62 is formed to be mild, and therefore can make it difficult for flushing water flowing along the bowl section bottom surface 20*a* from the lower end portion bottom surface 60*a* to remove.

By the Coanda effect, flow of a part of jet spout water flow flows along the bowl section bottom surface 20*a*, and forms flow that rises along the rising conduit 22*b* of the water discharge trap conduit 22 from the bottom surface 22*g*. The partial flow can flow into the inlet portion 22*a* of the water discharge trap conduit 22 while keeping the water force and the flow velocity along the bowl section bottom surface 20*a*. Accordingly, by filing the water discharge trap conduit 22 relatively early, the timing for startup of the siphon action that discharges waste can be advanced. Since the drain trap conduit 22 can be filled relatively early, so that the siphon can be efficiently started up with a small amount of flushing water.

Further, the virtual line X intersects the bottom surface 22*g* of the water discharge trap conduit 22 in the position A lower than the height of the central portion 22*f*. Therefore, the flushing water spouted from the jet spout port 32 joins the flow (refer to the arrow F3) along the bottom surface 22*g* of the water discharge trap conduit 22, in the position A. In the height position A, the flow of the flushing water spouted from the outlet 32*a* joins, in a state in which the water force of the flow along the bottom surface 22*g* of the water discharge trap conduit 22 is kept relatively strong, so that flow (refer to arrow F5) which flows in the water discharge trap conduit 22 smoothly is formed, with both flows combined. Therefore, relatively strong flow that pushes waste from the rising conduit bottom surface 22*e* of the water discharge trap conduit 22 is formed.

In the analysis result illustrated in FIG. 5, the main flow of the jet spout water flow flowing out from the jet spout port 32 passes through the lower side region B to form flow heading to the position A on the bottom surface 22*g*, as shown by an arrow F2. FIG. 5 shows that flow of flushing water heading to the lower side region B from the jet spout port 32 has a relatively high flow velocity and relatively strong water force. In this way, the main flow of the jet spout water flow pushes waste into the rising conduit 22*b* from the inlet portion 22*a* of the water discharge trap conduit 22, and can effectively discharge the waste. Further, the main flow of the jet spout water flow can generate an effect of involving and pushing a relatively large amount of flushing water and waste in the vicinity of the central portion 22*f*, and can efficiently discharge the waste.

In the analysis result illustrated in FIG. 5, as shown by the arrow F3, some flows divided along the bowl section bottom surface 20*a* from the main flow of the jet spout water flow by the Coanda effect are formed. FIG. 5 shows that the flow of the flushing water divided downward so as to be drawn to the bowl section bottom surface 20*a* side as shown by the arrow F3 have a relatively high flow velocity and large water force.

In this way, some flows divided along the bowl section bottom surface 20*a* flow along the bowl section bottom surface 20*a*, and form flows rising in the rising conduit 22*b* along the rising conduit bottom surface 22*e*, in a state keeping relatively high velocity and large water force. Therefore, the divided flows form the flows that fill the rising conduit 22*b* early. Accordingly, since the divided flows can fill the water discharge trap conduit 22 relatively early in this way, the timing for startup of the siphon action that discharges waste can be advanced.

When the flushing water spouted from the jet spout port 32 flows into the water discharge trap conduit 22, and fills the water discharge trap conduit 22, a siphon phenomenon is caused. By the siphon phenomenon, staying water and waste in the bowl section 20 are sucked into the water discharge trap conduit 22, and are spouted from a drain pipe (not illustrated) in a downstream side.

After a predetermined time elapses after flushing water is supplied to the toilet main body 2, the controller (not illustrated) finishes water spout from the rim spout port 26, stops the operation of the pressure pump 36, and ends a series of the washing operation.

Next, an operation in the flush toilet 1 according to the one embodiment of the present invention described above will be described.

First, according to the flush toilet 1 according to the one embodiment of the present invention, a part of the jet spout water flow spouted along the lower end portion bottom surface 60*a* of the outlet portion of the jet spout port 32 forms a flow along the bowl section bottom surface 20*a* of the bowl section 20 forming a curved surface diagonally inclined more downward than the lower end portion bottom surface 60*a* from the tip end of the lower end portion bottom surface 60*a* by the Coanda effect. Accordingly, the jet spout water flow that advances the timing for startup of the siphon action by reaching the water discharge trap conduit 22 relatively early along the bowl section bottom surface 20*a* of the bowl section 20, and the jet spout water flow that forms the flow that pushes waste toward the water discharge trap conduit 22 from the jet spout port 32 can be formed. Thereby, according to the flush toilet 1 of the present embodiment, in the siphon type flush toilet 1, discharge performance of waste from the inside of water discharge trap conduit 22 can be enhanced even with a smaller amount of flushing water.

Next, according to the flush toilet 1 according to the present embodiment, the jet spout port 32 spouts the jet spout water flow toward the lower side from the central portion 22*f* in the inlet portion 22*a* of the water discharge trap conduit 22. Therefore, the jet spout water flow joins the flow along the bowl section bottom surface 20*a* of the bowl section 20 by the Coanda effect, in the state in which the flow along the bowl section bottom surface 20*a* of the bowl section 20 keeps relatively strong water force. Accordingly, both the flows are combined to be able to form the flow that smoothly flows in the water discharge trap conduit 22, and the jet spout water flow can be restrained from generating the flow that hinders the flow in the water discharge trap conduit 22 by colliding with the inner surface of the water discharge trap conduit 22.

Further, according to the flush toilet 1 according to the present embodiment, the jet spout water flow joins the flow along the bowl section bottom surface 20*a* of the bowl section 20 by the Coanda effect, in the state in which the flow along the bowl section bottom surface 20*a* of the bowl section 20 has relatively strong water force. Accordingly, both the flows are combined to be able to form the flow that smoothly flows in the water discharge trap conduit 22, and the jet spout water flow can be restrained from generating the flow that hinders the flow in the water discharge trap conduit 22 by colliding with the inner surface of the water discharge trap conduit 22.

In addition, according to the flush toilet 1 according to the present embodiment, the angle between the lower end portion bottom surface 60*a* of the jet spout port 32, and the tangential line C2 of the bowl section bottom surface 20*a* of the bowl section 20 extending downward from the tip end of the lower end portion bottom surface 60*a* is formed to be the angle in the range of 140 degrees to 165 degrees, so that a part of the jet spout water flow is drawn to the bowl section bottom surface 20*a* and can flow along the bowl section bottom surface 20*a* by the Coanda effect. Therefore, the jet spout water flow that advances the timing for startup of the siphon action by reaching the water discharge trap conduit 22 relatively early along the bowl section bottom surface 20*a* of the bowl section 20, and the jet spout water flow that forms the flow that pushes waste toward the water discharge trap conduit 22 from the jet spout port 32 can be formed.

What is claimed is:

1. A flush toilet of a siphon type that is washed by flushing water supplied from a flushing water source, comprising:

a bowl section including a bowl-shaped waste receiving surface, and a rim section formed on an upper edge of the waste receiving surface;

a water discharge trap conduit that is connected to a lower portion of the bowl section; and a jet spout port including an outlet portion that is connected to the lower portion of the bowl section and is opened toward the water discharge trap conduit, wherein a bottom surface of the outlet portion and a bottom surface of the bowl portion are connected, wherein the bottom surface of the bowl section includes a curved surface that diagonally inclines downward from a tip end of the bottom surface of the outlet portion of the jet spout port, wherein the waste receiving surface comprises a concave portion above the jet spout port being inclined further downwardly than a front side bottom surface of the waste receiving surface below a water level defined by a top of a bottom surface of the water discharge trap conduit, and an inclined surface that inclines downwardly from the lower end of the concave portion to the outlet portion of the jet spout port, and wherein the concave portion comprises a concave portion inclined surface forming an inclination which is bigger than an inclination of the front side bottom surface, and an inclination of the inclined surface is smaller than the inclination of the concave portion inclined surface.

2. The flush toilet according to claim 1, wherein a flow path in the outlet portion of the jet spout port is directed toward an area lower than a central portion in an inlet of the water discharge trap conduit.

3. The flush toilet according to claim 1, wherein a ratio of an inclination angle of a rising conduit of the water discharge trap conduit to horizontal, and an inclination angle of the jet spout port to horizontal is set as a ratio in a range of 26 : 1 to 6.5 : 1.

4. The flush toilet according to claim 1, wherein an angle between the bottom surface of the outlet portion of the jet spout port, and a tangential line of the bottom surface of the bowl section, which extends downward from the tip end of the bottom surface of the outlet portion, is formed in a range of 140 degrees to 165 degrees.

* * * * *